US006058197A

United States Patent [19]

Delage

[11] Patent Number: 6,058,197

[45] Date of Patent: May 2, 2000

[54] MULTI-MODE PORTABLE PROGRAMMING DEVICE FOR PROGRAMMABLE AUDITORY PROSTHESES

[75] Inventor: David J. Delage, Portsmouth, N.H.

[73] Assignee: Etymotic Research, Elk Grove Village, Ill.

[21] Appl. No.: 08/730,634

[22] Filed: Oct. 11, 1996

[51] Int. Cl.[7] ..... H04R 25/00

[52] U.S. Cl. ..... 381/314; 381/312

[58] Field of Search ..... 381/68, 68.2, 68.4, 381/60, 314, 315, 312, 323

[56] References Cited

U.S. PATENT DOCUMENTS

| | | | |
|---|---|---|---|
| 4,887,299 | 12/1989 | Cummins et al. | 381/68.2 |
| 4,947,432 | 8/1990 | Topholm | 381/68.2 |
| 4,989,251 | 1/1991 | Mangold | 381/68.2 |
| 5,210,803 | 5/1993 | Martin et al. | 381/68 |
| 5,226,086 | 7/1993 | Platt | 381/68 |
| 5,390,254 | 2/1995 | Adelman | 381/68 |
| 5,404,407 | 4/1995 | Weiss | 381/68 |
| 5,604,812 | 2/1997 | Meyer | 381/68 |
| 5,717,771 | 2/1998 | Sauer et al. | 381/68 |
| 5,835,611 | 11/1998 | Kaiser et al. | 381/314 |

*Primary Examiner*—Ping Lee
*Attorney, Agent, or Firm*—McAndrews, Held & Malloy, Ltd.

[57] ABSTRACT

A programming apparatus combination for programming an auditory prosthesis comprises a computer system and a portable programming device. The computer system comprises a general purpose operating system, a user interface for accepting auditory prosthesis programming information from a user, and a communications interface for communicating the programming information from the personal computer. The portable programming device comprises a user interface for accepting auditory prosthesis programming information from a user, a communications port for receiving the programming information from the computer system, and a programming system having a first mode of operation in which the auditory prosthesis is programmed using information provided through the user interface of the portable programming device without a need for connection to the computer system, and a second mode of operation in which the auditory prosthesis is programmed using programming information received at the communications port from the communications interface of the computer system.

19 Claims, 4 Drawing Sheets

MULTI-MODE PORTABLE PROGRAMMING DEVICE FOR PROGRAMMABLE AUDITORY PROSTHESES

TECHNICAL FIELD

The present invention relates to a programming device for programming a programmable auditory prosthesis. More specifically, the present invention relates to a multi-mode portable programming device that is capable of operating in either a stand-alone mode or a slave mode for programming a programmable auditory prosthesis.

BACKGROUND

Programming devices for programming a programmable auditory prosthesis are known. Such devices generally fall into two divergent and distinct categories: so-called "stand-alone" portable programming devices which perform minimum, basic programming functions; and personal computer-based devices, which are capable of performing more sophisticated functions, including auditory device programming using the personal computer as the user interface and the principal computational device.

In general, stand-alone devices are microprocessor-based systems having limited storage and programming capabilities. Stand-alone devices include a user interface and are usually battery operated, since portability of the device is typically a concern. The user interface and corresponding application specific operating system of the stand-alone device enables it to perform programming functions independently of an external computer. The portability and low cost of the stand-alone devices, compared to their personal computer-based programming device counterparts, make them very useful for fitting or programming hearing aids in situations where external computers are impractical or unavailable. Examples of such situations include: nursing homes where some patients may be bedridden; patients' automobiles or other vehicles while traveling; and patient's offices or other workplaces. These devices are particularly useful for fitting a hearing aid in the environment in which the wearer intends to use the aid. Additionally, stand-alone devices can be readily operated whether or not the operator is familiar with operating a computer.

Where more sophisticated programming functions are desired, a personal computer-based device is desirable. One such device, known as a personal computer-based serial port programmer, is attached for control by a personal computer to an RS-232 serial interface. Such standard serial port programmers cannot function in a stand-alone capacity but, rather, must rely on receiving programming information from the personal computer to perform the requisite programming of the auditory prosthesis. Other personal computer-based devices are provided within the housing of the personal computer itself and communicate with the personal computer using the internal standard ISA bus.

The computational power of the personal computer allows the personal computer-based devices to provide programming functions that are significantly more advanced than those available in the stand-alone counterparts. Such advanced functions include: accepting hearing test results from a patient; predicting or formulating possible hearing aid solutions; graphing predicted outcomes of hypothetical hearing aid solutions; storing detailed information concerning both the patient and a prosthesis or prostheses worn by the patient; and programming two prostheses either simultaneously or individually. In contrast, the size, power, and portability requirements of known stand-alone devices render them incapable of performing all of these advanced programming functions.

The known programming devices for programmable auditory prostheses provide either a low cost portable device, or a more sophisticated and costly device capable of providing a variety of advanced functional tasks. The inventor, however, has recognized that successful fitting of a programmable auditory prosthesis may require all of the foregoing functions in a single programming system. This newly recognized need has not been met by any of the devices referenced above.

SUMMARY OF THE INVENTION

A portable programming device for programming an auditory prosthesis is set forth. The programming device preferably comprises a portable housing, a user interface disposed in the portable housing to facilitate entry of programming information by a user, and a communications port for receiving programming information from a personal computer system. The programming device also includes a multi-mode programming system. More particularly, the programming system has a first mode of operation in which the auditory prosthesis is programmed using information provided through the user interface without a need for connection to the personal computer system, and a second mode of operation in which the auditory prosthesis is programmed using programming information received at the communications port.

A programming apparatus combination for programming an auditory prosthesis is also set forth. The combination comprises a computer system and a portable programming device. The computer system comprises a general purpose operating system, a user interface for accepting auditory prosthesis programming information from a user, and a communications interface for communicating the programming information from the personal computer. The portable programming device comprises a user interface for accepting auditory prosthesis programming information from a user, a communications port for receiving the programming information from the computer system, and a programming system having a first mode of operation in which the auditory prosthesis is programmed using information provided through the user interface of the portable programming device without a need for connection to the computer system, and a second mode of operation in which the auditory prosthesis is programmed using programming information received at the communications port from the communications interface of the computer system.

Other advantageous features of the present invention will become apparent upon reference to the accompanying detailed description when taken in conjunction with the following drawings.

DETAILED DESCRIPTION OF THE PREFERRED EMBODIMENT

Figure 1:
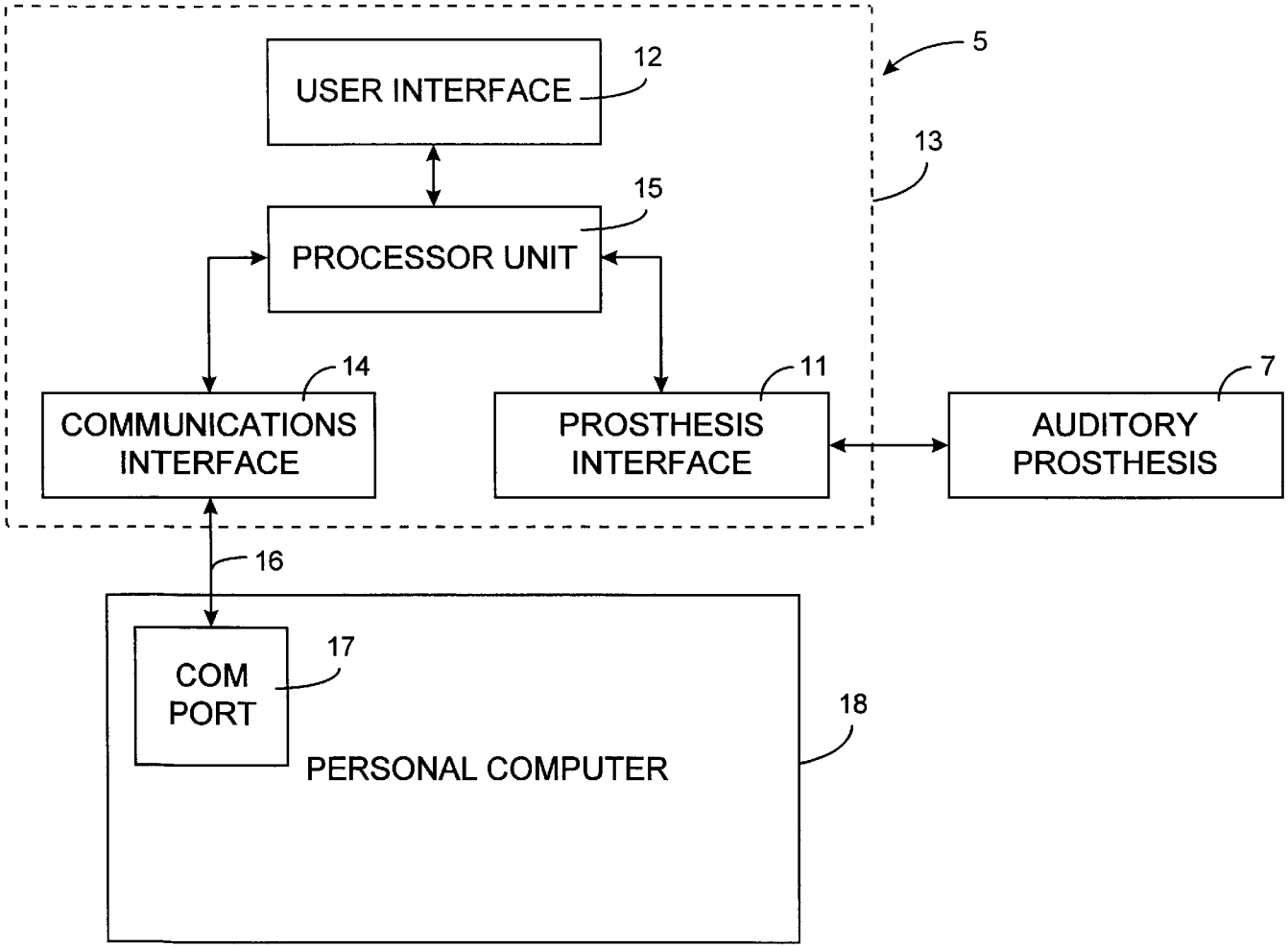
FIG. 1 is a system block diagram of a portable programming constructed in accordance with one embodiment of the invention.

As illustrated in FIG. 1, a portable programming device, shown generally at 5, for programming a programmable auditory prosthesis 7 includes a user interface 12, an auditory prosthesis interface 11, a communications interface 14, and a processor unit 15. Preferably, the foregoing components are associated with and integrated in a portable-size housing, shown generally here by the dotted line 13. The communications interface 14 is optionally connected for communication with a corresponding communication port 17 in a personal computer 18. The communication medium between the communications interface 14 and the corresponding communication port 17 may be, for example, a cable 16 connected therebetween. It will be recognized that the communications medium may, for example, be air in instances in which an infrared communications interface is used.

The portable programming device 5 contains a programming system which allows the device 5 to operate in two distinct modes. In a first, stand-alone mode, the portable programming device 5 receives programming information from a user through input from the user interface 12. The processor unit 15 processes the data input by the user through the user interface 12 and controls the prosthesis interface 11 to communicate programming information corresponding to the user input to the auditory prosthesis.

In a second, slave mode, the portable programming device 5 receives programming information from the personal computer 18 through the communications interface 14. As well recognized, the personal computer 18 may be a general purpose computer having a multipurpose operating system capable of executing a wide range of programmed operations. Such general purpose computers generally comprise a keyboard, a display, RAM, ROM, disk storage, and a CPU that are not dedicated to any one particular purpose. This is in contrast to the portable programming device 5 which includes an operating system specifically devoted to auditory device programming.

To generate the information that is to be transmitted to the portable programming device 5, the personal computer 18 includes an executable program that allows the user to input the information necessary to properly program the auditory prosthesis 7 and communicate that information via communications port 17 to the communications interface 14. Given that the personal computer 18 typically includes more and faster memory, a faster and more sophisticated processor, disk storage, etc., it is readily apparent that the personal computer 18 includes more processing power than does the portable programming device 5. As such, the executable program can be quite sophisticated, providing the user with detailed information and options that are not otherwise available when solely using the portable programming device 5.

Figure 2:
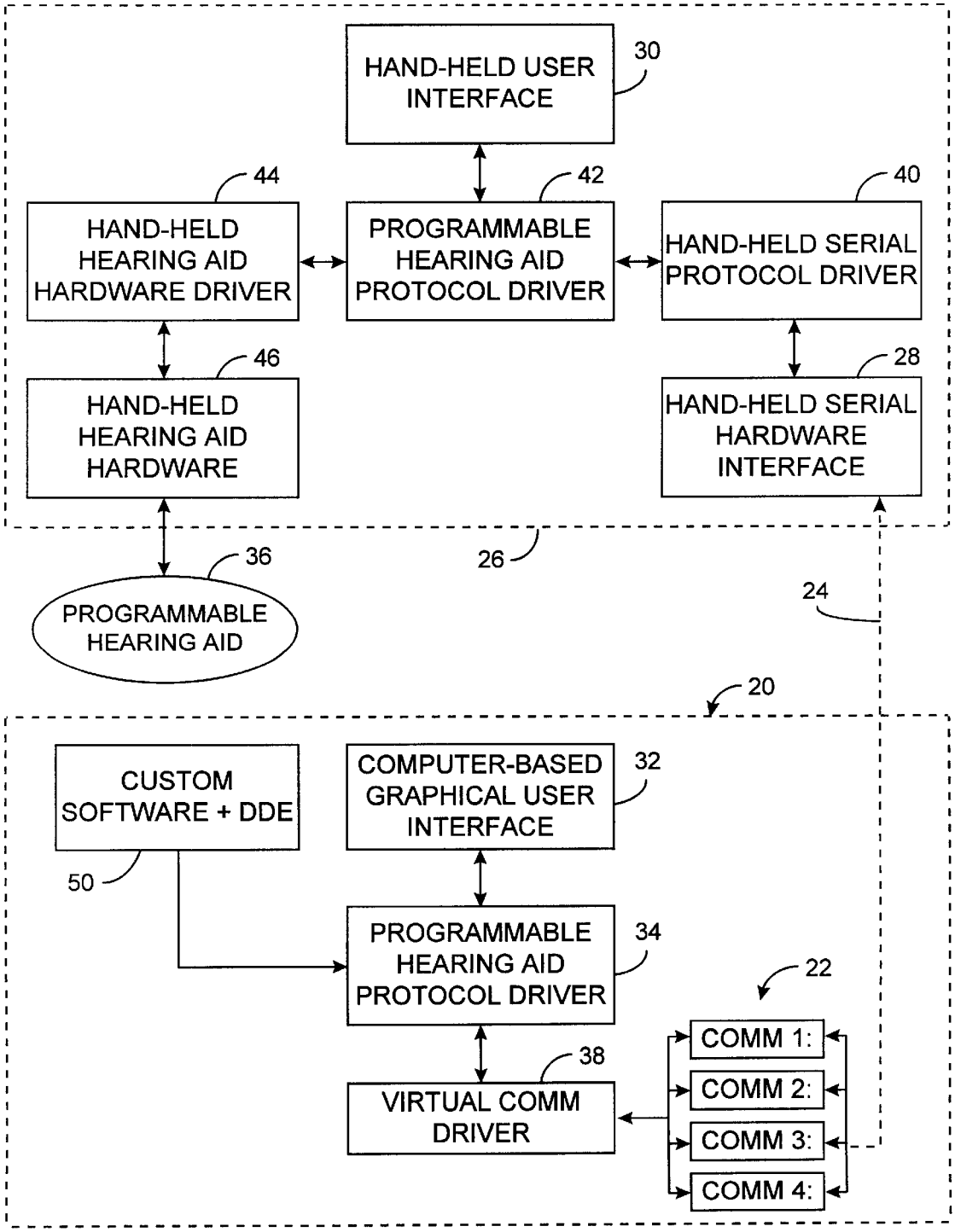
FIG. 2 is a more detailed system diagram of one embodiment of the device illustrated in to FIG. 1.

FIG. 2 illustrates one embodiment of the system of FIG. 1. In this embodiment, one of the serial communication ports 22 of the personal computer 20 is connected via a suitable medium 24 to the communications interface 14, shown here as the hand-held serial hardware interface 28, of the portable programming device 26. The serial hardware interface 28 allows the portable programming device to receive data from, and send data to, one of the communication ports 22.

The portable programming device 26 may be based on, for example, a Solo II available from DBC Mifco. In such instances, the serial hardware interface 28 is the only hardware addition required for converting the standard stand-alone device into the dual mode device set forth. Such a standard stand-alone device generally includes a battery-operated auditory prosthesis programmer that is controlled via a microprocessor. The battery-operated auditory prosthesis programmer can also be provided with a connector for connecting the device directly to an AC power source. The standard device accepts user input, displays messages and/or variable values, and communicates with an auditory prosthesis through commonly used programming protocols. Such standard operation characterizes the first, stand-alone mode of operation of the portable programming device 26. In the illustrated embodiment, the hand-held user interface 30 communicates the user input to a programmable hearing aid protocol driver 42. The programmable hearing aid protocol driver 42 communicates the information provided by the user to a hand-held hearing aid hardware driver 44. The hand-held hearing aid hardware driver 44 controls the hand-held hearing aid hardware 46 that is used to communicate the programming commands to the auditory prosthesis, shown here as a programmable hearing aid 36. The drivers 42 and 44 are generally implemented in the software executed by the microprocessor in the portable programming device 26 while the hand-held user interface 30 and the hand-held hearing aid hardware 46 are principally hardware devices that are controlled by the drivers.

The portable programming device 26 is connected to the personal computer 20 when operating in its second, slave mode. In this second, slave mode, a graphical user interface 32 of the personal computer 20 responds to a user command or input from, for example, a keyboard, mouse, or touch screen. The user command is received by a hearing aid protocol driver 34 of the personal computer 20, which generates information which is then interpreted by the hearing aid protocol driver 34 based on communication requirements of a hearing aid 36 connected to the portable programming unit 26. The user information is then forwarded to and received by a virtual communications driver 38 which, in turn, controls the appropriate communications port 22 to communicate the information to the hand-held serial hardware interface 28 of the portable programming device 26.

Once it is received at the hand-held serial hardware interface 28, the signal is communicated to a hand-held serial protocol driver 40. The signal is then forwarded to and received by the programmable hearing aid protocol driver 42, where it is indistinguishable from user input at the hand-held user interface 30 of the selectively actuated portable programming device 26. The hand-held serial protocol driver 40 constitutes an additional software routine which is added to the foregoing standard portable programmable device and which is executed by the microprocessor included therein. The programming of the programmable hearing aid 36 beyond the programmable hearing aid protocol driver 42 proceeds in a manner that is identical to the operation of the components when the portable programming device 26 is in the stand-alone mode.

Information regarding parameters of the programmable hearing aid 36 can be forwarded from the programmable hearing aid 36 back to the personal computer 20 through a sequence that is the reverse of that set forth above for communicating control signals from a user at the personal computer 20 to the programmable hearing aid 36. The parameter information can then be manipulated, stored, plotted, etc., by custom software and DDE 50.

The graphical user interface 32 and the programmable hearing aid protocol driver 34 may be the same driver as used to communicate programming information to a more conventional personal computer-based programming device. The interface 32 and driver 34 may, for example, be software such as that available from DBC Mifco under the name UX Solo™. In such instances, the hearing aid protocol driver 34 of the personal computer 20 may be modified to automatically detect the presence of either the conventional personal computer-based programming device (which need not be present for the system to operate) or the hand-held serial hardware interface 28 of the portable programming device 26 when one or the other is present. The hearing aid protocol driver 34 can then configure the system to communicate with the proper protocol through the proper interface without operator intervention.

In accordance with a further modification of the portable programming device 26, contemporaneous programming of multiple auditory prostheses is possible in the second, slave mode of operation. This can be accomplished, for example, by using two of the hand-held hearing aid hardware circuits 46, as opposed to the single one illustrated.

The advanced programming capabilities of the personal computer 20, such as curve plotting/predicting, and storage of both patient test results and hearing aid settings are provided by a suitable data exchange system, such as the Windows Dynamic Data Exchange (DDE) standard 50, which provides the personal computer 20 with custom software programming abilities.

Two-way communication between the portable programming device 26 and the personal computer 20 would conventionally be achieved by modifying the selectively portable programming device 26 using an RS-232 interface between the devices. Such a modification is not necessarily optimal, due to the costs, spatial requirements, and resulting battery drain of such a modification.

As a result, the presently disclosed embodiment relies on a much easier and more cost effective serial port connection. Specifically, since limited data bytes (typically less than seven bytes) and short cable lengths are required, a fully functional and fast serial port is not necessary to the basic functioning of the two-way communication between the selectively actuated portable programming device 26 and the personal computer 20. Rather, the clear to send (CTS) and request to send (RTS) lines are addressed directly within the conventional computer operating system software of the personal computer 20 and are used to communicate with the hand-held serial hardware interface 28.

Figure 3:
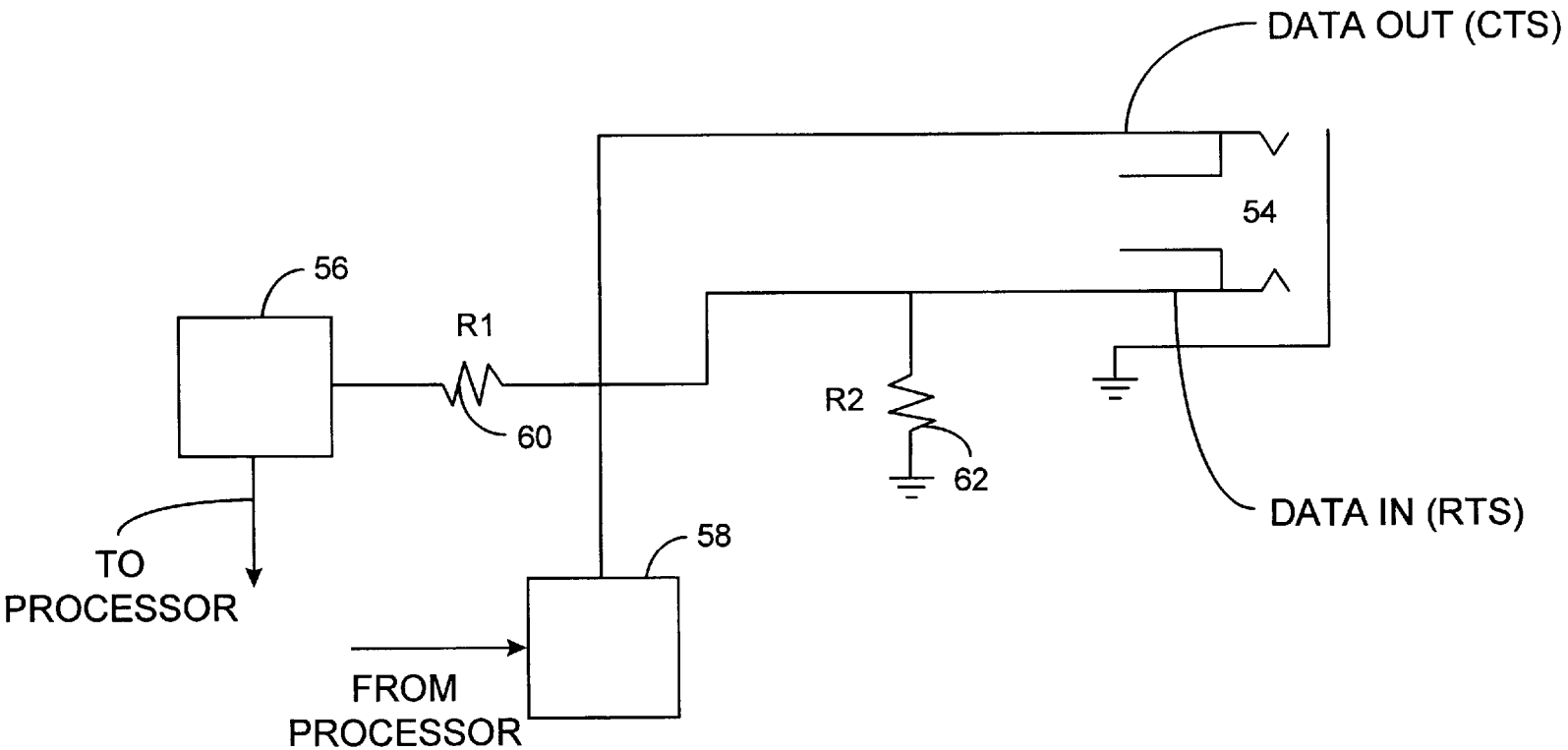
FIG. 3 is a schematic diagram of one embodiment of a hardware modification to an existing portable programming device to facilitate serial communication with the communications port of a personal computer.

One embodiment of a serial hardware interface 28 suitable for use in such a system is illustrated in FIG. 3. The illustrated interface 28 is constructed using a plug 54, resistors 60 and 62, an input line buffer 56, and an output line driver 58. The input line buffer 56 may, for example, be a TTL-level buffer such as a 74HC241 integrated circuit. The output line driver 58 may, for example, be a TTL-level driver such as a 74HC374 integrated circuit. One or both of the buffer 56 and driver 58 may exist in a standard portable programming device such as the Solo II™ referenced above.

Investigations have revealed that while the output from the communications port 22 is at +12 volts for a logical high and at −12 volts for a logical low, the standard serial port input devices register a low for any voltage below +1 volt and a high for any voltage above +2 volts. Thus, the portable programming device 26 can send data to the CTS input of the personal computer 20 using standard TTL signal levels. Resistor 60 serves as a current limiting resistor to limit the current to the input buffer 56 to a level well below the 20 mA specification of most TTL-level parts. Further, resistor 62 is provided to protect the circuit from static discharge and to guarantee a low when the portable programming device 26 and the personal computer 20 are not communicating.

In a preferred embodiment, the microprocessor and related components of the selectively actuated portable programming device 26 are CMOS components that reduce battery drain. The user interface 30 may be a laminated domed keypad for ruggedness, and may optionally include a two line by sixteen character LCD display to provide adequate message space while maintaining low battery drain.

Figure 4:
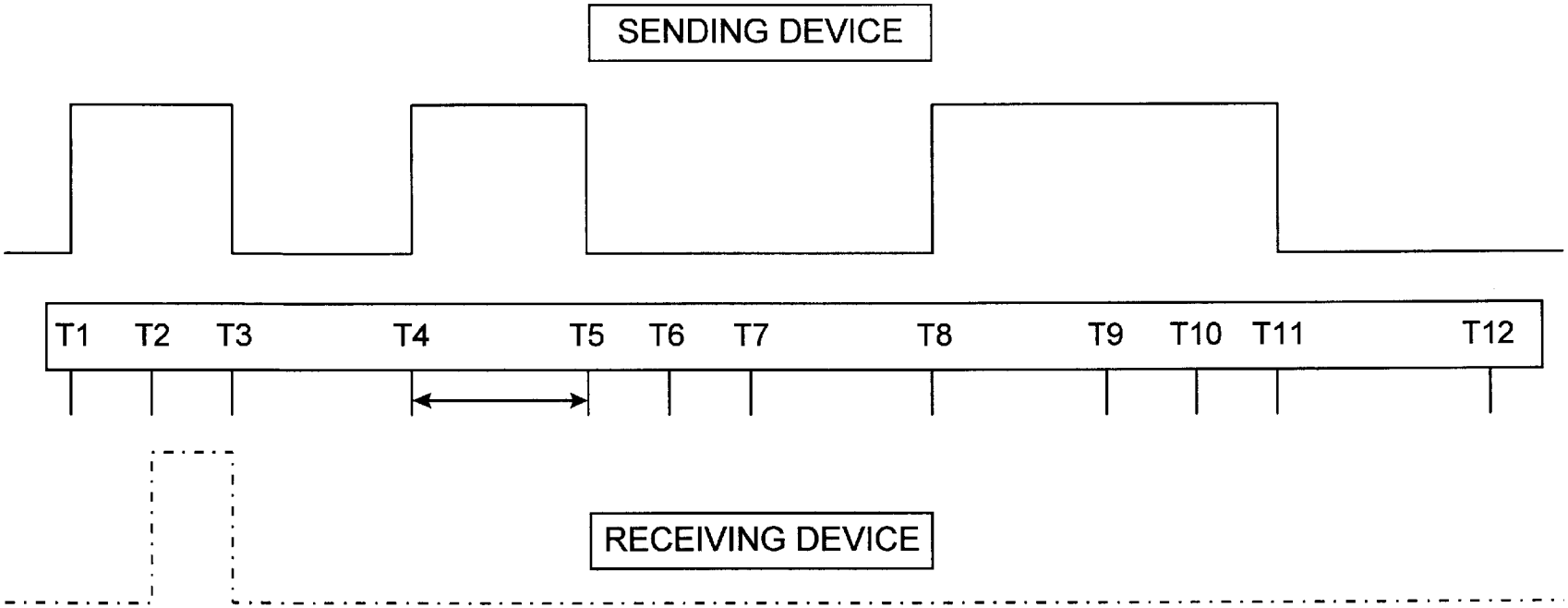
FIG. 4 is a timing diagram which sets forth one embodiment of a synchronous data transmission protocol that may be used to transmit serial data between the portable programming device and the personal computer.

One embodiment of a communications protocol suitable for use in transmitting a single bit in the foregoing CTS/RTS data system is illustrated in FIG. 4. The clear to send (CTS) and request to send (RTS) lines can be directly addressed within a UART that is addressable by the microprocessor of the personal computer 20. Similarly, the buffer 56 and the driver 58 can be directly addressed by the microprocessor of the portable programming device 26.

Each data bit is communicated across the CTS and RTS lines using a synchronous protocol. First, the personal computer 20 of FIG. 2 sends a high level (T1) to the portable programming device 26. The personal computer 20 then waits for the portable programming device 26 to send a high level (T2) signal in acknowledgement of the (T1) signal. Next, both the portable programming device 26 and the personal computer 20 send a low signal at (T3), allowing the portable programming device to conserve battery power in, for example, a sleep mode actuated by a timer interrupt to see if a high level signal is present from the personal computer 20. Given a previously defined time X, the sending device then sends high level (T4, T8) signals for X time, followed by data bit level signals (T5=LO, T9=Hi), for X time, which are then followed with zero signals (T7, T11) for X time.

Starting at the leading edge of the high level (T4, T8) signals, the portable programming device 26 delays for 1.5X time until (T6, T10), and then reads and stores the data bit value. The portable programming device 26 then continues to monitor the line for another high level signal. The sending/receiving process continues, as described above, if another high level signal is present from the sending device. Otherwise, if another high level signal is not received by time (T12), or within 2X times, the communications are deemed complete. Data encoded within the bit stream can include, for example, the hearing aid protocol name, the desired command, and any other required data.

The foregoing timing sequence is also used by the portable programming device 26 to transmit data bits to the personal computer 20. As illustrated, irrespective of which device is transmitting the bits, the lines are normally held low. In any transmission of N bits, and array of 3N bits is created. The first bit is 1. The second bit is the $1^{st}$ N bit. The third bit is 0. The fourth bit is 1. The fifth bit is the $2^{nd}$ N bit. The sixth bit is 0, etc. That is, each three bit group comprises a logical 1 and a logical 0, with the Nth bit inserted between them.

The hand-held serial protocol driver 40 preferably responds to the virtual communication driver 38 with at least a single bit answer. The answer, such as a high, from the receiving device can indicate that the requested action was completed without error. Alternatively, the answer, such as a low, can indicate that an error occurred.

Commands from the computer can begin with, for example, four bits that specify the hearing aid programming protocol. The next four bits may then be used to specify the command. The following exemplary sequence of commands assumes an ER-102 Digital ScrewDriver® (available from Etymotic Research®, Inc.) protocol. Of course, other protocols may have other bit requirements. The sequence of commands can include the following transmissions.

0000—specifies that the portable programming device is operating on main power and should poll the transmission line as fast as possible, and should not go to sleep, where the programmer returns one bit and a high level signal indicates success.

1000—turns on a hearing aid connected to the portable programming device, where the programmer returns eight bits of data for the hearing aid battery current, and where a current below 0.1 mA indicates that no hearing aid is connected.

0100—turns the hearing aid off, where the programmer returns one bit and a high level signal indicates success.

1100—turns the programmer off, where the programmer returns a high level signal indicating success prior to turning off.

0010—performs a read, and twelve additional bits that are the correct preamble for the memory requested and the manufacturer requested, or the special manufacture code if access to the system memory is requested, are sent by the request and the portable programmer returns the forty bits sent by the hearing aid and one additional bit, where a high in the additional bit indicates that all forty bits were received.

1010—performs a write/burn and forty additional bits for the complete normal write sequence for the memory and manufacturer settings are sent by the request, where the portable programmer returns one bit and a high level signal indicates success.

0110—performs a write without burn, and otherwise identical to 1010 as previously described, except now the data controls the hearing aid but is not placed in hearing aid memory, which can save time by eliminating burn pulses that are not always required during hybrid or production testing.

1110—returns hearing aid timing, and timing is returned as eight bits for the sync pulse width ratio in %, that is 95 decimal is a five percent faster than normal sync pulse width sent as binary 11111010 (LSB first), which is a necessary function in the ER-102 Digital Screwdriver that may or may not be used by other protocols.

Further software changes in the portable programming device provide for the detection of the presence of a signal from the computer. Thus, where a high signal level, or above +2 volts in the particular embodiment shown, is detected from the computer, the software in the portable programming device detects the high signal level and the portable programming device immediately enters the second, slave mode of operation. The portable programming device can then send a signal to the computer acknowledging that it is present. The computer can recognize the presence of the programming device during the automatic hardware detection procedure, thereby eliminating the need for additional hardware at the computer end of the link to detect the presence of the portable programming device. Such software can be used to detect whether the portable programming device or a standard serial programmer is connected to the communications port of the computer.

A portable programming device constructed in accordance with the principles discussed herein provides all of the needed functionality of an auditory prosthesis programming device both in terms of portability and in terms of computational power.

Although the present invention has been described with reference to specific embodiments, those of skill in the art will recognize that changes may be made thereto without departing from the scope and spirit of the invention as set forth in the appended claims.

I claim as my invention:

1. A single programming device for programming an auditory prosthesis, the programming device comprising:

a) a portable housing, the portable housing being separate from a portable housing of the auditory prosthesis;

b) a user interface disposed in the portable housing to facilitate entry of programming information by a user;

c) a communications port disposed in the portable housing for receiving programming information from a personal computer system; and d) a programming system disposed in the portable housing having a first mode of operation in which the auditory prosthesis is programmed using information provided through the user interface without a need for connection to any separate computer system, and a second mode of operation in which the programming device acts as a communication link between a separate computer system and the auditory prosthesis, and in which the auditory prosthesis is programmed using programming information received at the communications port from the separate computer system without requiring input of programming information at the user interface.

2. A portable programming device as claimed in claim 1 wherein the programming system uses the communications port to transmit information on the auditory prosthesis to the personal computer system.

3. A portable programming device as claimed in claim 1 and further comprising a personal computer connected to the communications port, the personal computer comprising a universal asynchronous receiver/transmitter having an addressable request to send data line and an addressable clear to send data line, the request to send data line and the clear to send data lines being used to transmit data between the personal computer and the programming device.

4. A portable programming device as claimed in claim 1 and further comprising a personal computer connected to the communications port, the personal computer comprising a serial communications port, the serial communications port of the personal computer being used to transmit data between the personal computer and the programming device.

5. A portable programming device as claimed in claim 1 and further comprising a personal computer, the personal computer comprising software for communicating with either the portable programming device or a personal computer-based programmer.

6. A portable programming device as claimed in claim 5 wherein the software automatically detects which of the portable programming device or the personal computer-based programmer is connected to the personal computer.

7. A portable programming device as claimed in claim 1 wherein the programmable auditory prosthesis is a hearing aid and the programming system comprises:

a) a programmable hearing aid protocol driver implemented in software for receiving information input by a user from the user interface;

b) a hearing aid hardware driver implemented in software for receiving programming information from the programmable hearing aid protocol driver;

c) a hearing aid hardware interface connecting the portable programming device to the hearing aid, the hearing aid hardware interface being controlled by commands generated by the hearing aid hardware driver.

8. A portable programming device as claimed in claim 1 wherein the communications port comprises an infrared communications port.

9. A programming apparatus combination for programming an auditory prosthesis, the combination comprising:

a) a computer system comprising i. a general purpose operating system, ii. a user interface for accepting auditory prosthesis programming information from a user, and iii. a communications interface for communicating the programming information from the computer system; and b) a single portable programming device having a portable housing, the portable housing being separate from a portable housing of the auditory prosthesis, the portable programming device comprising i. a user interface disposed in the portable housing for accepting auditory prosthesis programming information from a user, ii. a communications port disposed in the portable housing for receiving the programming information from the computer system, and iii. a programming system disposed in the portable housing having a first mode of operation in which the auditory prosthesis is programmed using information provided through the user interface of the portable programming device without a need for connection to any separate computer system, and a second mode of operation in which the portable programming device acts as a communication link between the computer system and the auditory prosthesis, and in which the auditory prosthesis is programmed using programming information received at the communications port from the communications interface of the computer system without requiring input of programming information at the user interface of the portable programming device.

10. A programming combination as claimed in claim 9 wherein the user interface, communications port, and the programming system of the portable programming device are disposed in a single housing.

11. A programming combination as claimed in claim 9 wherein the programming system uses the communications port to transmit information on the auditory prosthesis to the computer system.

12. A programming combination as claimed in claim 9 wherein the computer comprises a universal asynchronous receiver/transmitter having an addressable request to send data line and an addressable clear to send data line, the request to send data line and the clear to send data lines being used to transmit data between the personal computer and the programming device.

13. A programming combination as claimed in claim 9 wherein the communications interface of the computer comprises a serial communications port.

14. A programming combination as claimed in claim 13 wherein the serial communications port of the computer is connectable to either the communications port of the portable programming device or to a personal computer-based serial port programmer, the computer comprising software for communicating with either the portable programming device or the serial port programmer.

15. A programming combination as claimed in claim 14 wherein the software automatically detects which of the portable programming device or the personal computer-based serial port programmer are connected to the serial communications port of the computer.

16. A programming combination as claimed in claim 9 wherein the programmable auditory prosthesis is a hearing aid and the programming system comprises:

a) a programmable hearing aid protocol driver implemented in software for receiving information input by a user from the user interface;

b) a hearing aid hardware driver implemented in software for receiving programming information from the programmable hearing aid protocol driver;

c) a hearing aid hardware interface connecting the portable programming device to the hearing aid, the hearing aid hardware interface being controlled by commands generated by the hearing aid hardware driver.

17. A programming combination as claimed in claim 9 wherein the communications between the portable programming device and the computer take place using infrared communications.

18. A single portable programming device for programming an auditory prosthesis, the programming device comprising:

(a ) a portable housing, the portable housing being separate from a portable housing of the auditory prosthesis;

(b) a prosthesis interface disposed in the portable housing for communicatively coupling with an auditory prosthesis;

(c) first user interface disposed in the portable housing and operatively coupled to the prosthesis interface; and (d) a communications interface disposed in the portable housing and operatively coupled to the prosthesis interface, said first user interface facilitating programming of the auditory prosthesis directly at the portable housing without requiring that programming information from any separate computer system be received at the communications interface, and said communications interface facilitating independent programming of the auditory prosthesis through the portable programming device via a second user interface of a separate computer system located externally to the portable housing of the portable programming device and communicatively coupled to said communications interface without requiring input of programming information at the first user interface disposed in the portable housing of the portable programming device.

19. A programming system for programming an auditory prosthesis, the system comprising:

(a) a single portable programming device having a portable housing, the portable housing being separate from a portable housing of the auditory prosthesis, the portable programming device comprising i. a prosthesis interface disposed in the portable housing for communicatively coupling with an auditory prosthesis;

ii. a first communications interface disposed in the portable housing operatively coupled with the prosthesis interface; and iii a first user interface disposed in the portable housing operatively coupled with the prosthesis interface to facilitate programming of the auditory prosthesis in a first programming mode without requiring that programming information from any separate computer system be received at the first communications interface; and (b) a personal computer comprising i. a second communications interface for communicatively coupling with the first communications interface of the portable programming device; and ii. a second user interface operatively coupled with the second communications interface to facilitate programming of the auditory prosthesis in a second programming mode in which the portable programming device acts as a communication link between the personal computer and the auditory prosthesis and in which the auditory prosthesis is programmed using programming information input at the second user interface of the personal computer without requiring input of programming information at the first user interface of the portable programming device.

* * * * *